US010189658B2

(12) United States Patent
Sperl

(10) Patent No.: US 10,189,658 B2
(45) Date of Patent: Jan. 29, 2019

(54) STACKING DEVICE FOR STACKING VALUE DOCUMENTS

(71) Applicant: GIESECKE & DEVRIENT GMBH, München (DE)

(72) Inventor: Markus Sperl, Garching (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/507,146

(22) PCT Filed: Aug. 27, 2015

(86) PCT No.: PCT/EP2015/001751
§ 371 (c)(1),
(2) Date: Feb. 27, 2017

(87) PCT Pub. No.: WO2016/030018
PCT Pub. Date: Mar. 3, 2016

(65) Prior Publication Data

US 2017/0275109 A1 Sep. 28, 2017

(30) Foreign Application Priority Data

Aug. 29, 2014 (DE) ..... 10 2014 012 867

(51) Int. Cl.
*B65H 29/68* (2006.01)
*B65H 29/14* (2006.01)
(Continued)

(52) U.S. Cl.
CPC ..... *B65H 3/0638* (2013.01); *B65H 3/50* (2013.01); *B65H 5/062* (2013.01); *B65H 29/125* (2013.01);
(Continued)

(58) Field of Classification Search
CPC ..... B65H 29/68; B65H 29/14; B65H 29/22; B65H 5/06; B65H 5/062; B65H 2404/1411; B65H 2404/1344
See application file for complete search history.

(56) References Cited

U.S. PATENT DOCUMENTS 4,364,552 A * 12/1982 Besemann ..... B65H 29/6627 271/182

FOREIGN PATENT DOCUMENTS

DE 3007435 A1 10/1981
JP 01192661 A * 8/1989
(Continued)

OTHER PUBLICATIONS

German Search Report for corresponding German Application No. 102014012867.9, dated May 6, 2015.
(Continued)

*Primary Examiner* — Luis A Gonzalez
(74) *Attorney, Agent, or Firm* — Workman Nydegger

(57) ABSTRACT

A stacking apparatus for value documents, having a stack deposit device and a braking device which is arranged along the transport path of the value documents immediately before the stack deposit device. On the transport shaft of the braking device at least one driving roller is firmly mounted and at least one roller rotatably supported on the transport shaft. At least one cam roller is firmly mounted on a braking shaft of the braking device and at least one eccentric roller. By a rotation of the braking shaft, the eccentric roller can electively be brought in engagement with the opposing driving roller so that a value document becomes clamped between these, or be brought out of engagement with the opposing driving roller, so that the value document is no
(Continued)

longer clamped between these, but rather is brakable by the engagement between the cam roller and the rotatably supported roller.

22 Claims, 3 Drawing Sheets

(51) Int. Cl.

| | |
|---|---|
| ***B65H 5/06*** | (2006.01) |
| ***B65H 3/06*** | (2006.01) |
| ***B65H 29/12*** | (2006.01) |
| ***B65H 3/50*** | (2006.01) |
| ***B65H 29/32*** | (2006.01) |
| ***B65H 31/36*** | (2006.01) |

(52) U.S. Cl.

CPC ..... *B65H 29/14* (2013.01); *B65H 29/32* (2013.01); *B65H 29/68* (2013.01); *B65H 31/36* (2013.01); *B65H 2211/00* (2013.01); *B65H 2301/331* (2013.01); *B65H 2301/4212* (2013.01); *B65H 2404/1114* (2013.01); *B65H 2404/1344* (2013.01); *B65H 2404/1411* (2013.01); *B65H 2511/166* (2013.01); *B65H 2511/242* (2013.01); *B65H 2511/514* (2013.01); *B65H 2513/11* (2013.01); *B65H 2513/51* (2013.01); *B65H 2557/242* (2013.01); *B65H 2701/1311* (2013.01); *B65H 2701/1313* (2013.01); *B65H 2701/1912* (2013.01)

(56) References Cited

FOREIGN PATENT DOCUMENTS

| | | | |
|---|---|---|---|
| JP | 07223764 A | * | 8/1995 |
| JP | H08198493 A | | 8/1996 |

OTHER PUBLICATIONS

International Search Report for corresponding International PCT Application No. PCT/EP2015/001751, dated Jan. 4, 2016.

* cited by examiner

STACKING DEVICE FOR STACKING VALUE DOCUMENTS

BACKGROUND

The invention relates to a stacking apparatus for stacking value documents, such as bank notes, checks, vouchers, tickets, cards, as well as a value-document processing apparatus comprising such a stacking apparatus and a method for stacking the value documents with the help of the stacking apparatus.

In value-document processing apparatuses in which the value documents are transported at high transport velocity, stacking wheels for stacking the value documents are usually used which have sheet slots distributed over the circumference for receiving respectively one value document to be stacked. The sheet slots in the stacking wheel have a substantially spiral-shaped pattern. With regard to small value-document processing apparatuses, such stacking wheels are disadvantageous because of their large space requirements.

Further known is the stacking of value documents to a deposit means without the aid of a stacking wheel. Here, the value documents are continued to be moved from the transport path until they leave the engagement of the transport elements, e.g. transport rollers, and then on account of the gravitational force fall on the deposit means below or into a value-document cassette. Where applicable, a pusher is employed for actively pressing down the value document in the direction of the deposit means. Disadvantageous with such stacking apparatuses is the fact that they are suitable only for low transport velocities. When increasing the transport velocity, the quality of the deposited value-document stack deteriorates considerably.

SUMMARY

It is hence one object of the invention to state a stacking apparatus which is suitable for stacking value documents which are transported with high transport velocity, and which has a low space requirement.

The stacking apparatus is configured for stacking value documents which are individually transported by a transport system at a transport velocity to the stacking apparatus and comprises:

- a stack deposit means for receiving a stack of the value documents,
- a braking device for braking the value documents which were individually transported by the transport system to the stacking apparatus. The braking device is arranged along the transport path of the value documents immediately before the stack deposit means and provides the last clamping of the value document before the stack deposit means.

The braking device has a transport shaft and a braking shaft between which the respective value document is transported through. On the transport shaft there is mounted at least one driving roller, which is firmly mounted (i.e. not supported) on the transport shaft, and—axially offset to the driving roller—at least one rotatably supported roller on the transport shaft. Further, on the braking shaft there is mounted at least one cam roller, which is firmly mounted (i.e. not supported) on the braking shaft, and there is—axially offset to the cam roller—at least one eccentric roller, which has an eccentric core firmly mounted on the braking shaft in eccentric position and a rotatably supported eccentric roller on the eccentric core.

The rotatably supported roller mounted on the transport shaft and the cam roller mounted on the braking shaft lie directly opposite each other with regard to the transport path of the value documents. By the rotation of the braking shaft, the cam of the cam roller can electively be brought in engagement with the opposing rotatably supported driving roller, so a value document being transported therebetween is clamped between these, or be brought out of engagement with the opposing rotatably supported roller so that the value document being transported therebetween is not clamped between the cam of the cam roller and the opposing rotatably supported roller.

Also the driving roller mounted on the transport shaft and the eccentric roller mounted on the braking shaft lie directly opposite each other with regard to the transport path of the value documents. By a rotation of the braking shaft, the eccentric roller can electively be brought in engagement with the opposing driving roller so that a value document between these becomes clamped, or be brought out of engagement with the opposing driving roller so that the value document is not clamped between the driving roller and the eccentric roller.

By the eccentricity of the eccentric roller and its phasing relative to the cam of the cam roller, it is attained that the clamping of the value document is released between the driving roller and the eccentric roller on time, shortly before the clamping between the cam of the cam roller and the rotatably supported roller sets in. In extreme cases this can also take place simultaneously. Thus the value document which is driven by the driving roller with a high transport velocity can be braked down abruptly to the lower transport velocity which is pre-specified by the rotation of the braking shaft and is transferred to the value document by the cam of the cam roller. Since the eccentric rollers and the cam rollers are mounted on the same shaft (on the braking shaft), there results a very compact construction of the stacking apparatus according to the invention.

The transport shaft and the braking shaft are arranged—as viewed along the value document's transport path—at the same coordinate, however, on opposing sides of the transport path. In comparison to a braking shaft which lies along the transport path at a coordinate behind the last transport clamping, this has the advantage that the value document is driven up to the last-possible moment before the braking. Thereby it is ensured that the next value document cannot run onto the preceding value document. Thus a rapid succession of the value documents becomes possible, in spite of the braking, and therefore a high throughput of value documents is attained.

To attain a controlled transporting and braking, the cam of the cam roller and the driving rollers are preferably equipped on their surface with a material with increased friction, e.g. rubber.

For realizing the invention it can suffice if there is mounted on the transport shaft only one driving roller and on the braking shaft correspondingly only one eccentric roller, and/or on the braking shaft only one cam roller and on the transport shaft correspondingly only one rotatably supported roller. If only one respective roller is employed, this is configured preferably a little wider (roller-shaped). In an embodiment example, however, several driving rollers and several rotatably supported rollers on the transport shaft are mutually axially offset and several eccentric rollers and several cam rollers on the braking shaft are mutually axially offset.

In a first angle range of the braking shaft rotation, the respective value document is urged against (clamped to) the opposing driving roller by the eccentric roller in order for the value document to be further transported by the driving roller. During the engagement of the respective eccentric roller with the respective driving roller, the cam of the cam roller is not in engagement with the respectively opposing rotatably supported roller so that the value document is not clamped between the cam of the cam roller and the rotatably supported roller. In the first angle range of the braking shaft rotation, there exists a distance between the cam roller and the rotatably supported roller in which the respective value document is not urged against/clamped to the rotatably supported roller by the cam of the cam roller, but rather is movable relative to the cam roller. The distance between the cam of the cam roller and the rotatably supported roller is so large in the first angle range of the braking shaft rotation that the respective value document is movable relative to the cam roller, but is not urged against/clamped to the rotatably supported roller by the cam of the cam roller.

In a second angle range of the braking shaft rotation, which does not overlap with the first angle range, the cam of the cam roller is brought in engagement with the opposing rotatably supported roller so that the value document can be clamped between these and can be braked—relative to the driving roller—by the cam. During the engagement of the cam of the respective cam roller with the respective rotatably supported roller, the respective eccentric roller is not in engagement with the opposing driving roller so that the value document is not clamped between the driving roller and the eccentric roller, but is brakable relative to the driving roller. The distance between the cam roller and the rotatably supported roller is in the second angle range of the braking shaft rotation zero or so small that the value document is clamped between these and can be braked relative to the driving roller.

The cam of the cam roller and the eccentric core of the eccentric roller are so mounted at a mutual angular offset on the braking shaft that for that angle range of the braking shaft rotation in which the eccentric roller is urged onto the opposing driving roller, the cam of the cam roller is not in engagement with the opposing rotatably supported roller, but rather there remains a space between cam of the cam roller and the opposing rotatably supported roller. In that angle range in which the cam of the cam roller is in engagement with the opposing rotatably supported roller, the eccentric roller is not in engagement with the opposing driving roller, but rather there remains a space between the eccentric roller and the driving roller in which the respective value document is not urged against the driving roller, but rather is brakable relative thereto.

Preferably there is attached on that shaft of the braking device which is arranged below the value-document transport path (hereinafter designated as a lower shaft)—this can be the braking shaft (if this is below) or the transport shaft (if this is below)—at least one auxiliary element which is firmly mounted on the lower shaft. In the angle range of the cam, the auxiliary element protrudes radially beyond the cam. For example, the auxiliary element can have the form of a hook, however, it can also be a straight element oriented radially toward the braking shaft.

With the auxiliary element the rearward end of the value document can be urged in the direction of the stack deposit means upon rotating the braking shaft. The auxiliary element is so mounted on the lower shaft that upon rotation the braking shaft it urges the rearward end of the value document in the direction of the stack deposit means, after the trailing edge of the value document has left the clamping between the cam and the rotatably supported roller. Upon the rotation of the braking shaft, the auxiliary element touches the value document only after the cam of the cam roller has begun clamping the value document. The auxiliary element can be configured rigidly or flexibly. Preferably several auxiliary elements are arranged mutually axially offset on the lower shaft, e.g. distributed over the width of the value document. A controlled depositing of the value document with further improved stacking quality is attained by one or several such auxiliary elements.

The stacking apparatus according to the invention has further a control device which is configured to carry out the stacking of the value documents as described.

The rotation of the braking shaft is effected not at constant velocity, but rather according to a velocity profile which will run through periodically exactly once for every value document to be braked. The velocity profile is so chosen that the braking shaft at first does not rotate as long as the leading edge and the leading portion (e.g. the front half) of the value document are being transported past the braking device. At a time point while the trailing part (e.g. the back half) of the value document is transported past the braking device, the rotation of the braking shaft is begun and the angular velocity of the cam roller is accelerated to a braking velocity, which is substantially lower than the transport velocity with which the transport shaft is (constantly) rotated. The rotation of the braking shaft with the braking velocity will be maintained for a braking period, at least until the trailing edge of the value document leaves the clamping between the cam of the cam roller and the rotatably supported roller. The rotation of the braking shaft is then accelerated to an angular velocity for which the angular velocity of the cam is higher than the angular velocity of the driving rollers, and is then again stopped and paused until the next value document is to be braked.

Preferably the rotation of the braking shaft is coordinated with the arrival time of the leading edge and trailing edge of the value documents so that the engagement between the cam of the cam roller and the rotatably supported roller begins at a place on the value document which lies in the trailing half of the value document. Along the circumference of the cam roller the cam is so long that this engagement remains at least until the trailing edge of the value document leaves the clamping between the cam of the cam roller and the rotatably supported roller.

The transport shaft is rotated with a constant velocity, which is preferably so chosen that the circumferential velocity of the driving roller corresponds (at least approximately) to the transport velocity at which the value documents are being transported by the transport system to the braking device. Thus an unwanted compression of the value document is avoided upon arrival at the braking device.

Moreover, the braking device can be configured to straightly align value documents transported obliquely. For this purpose the braking device can have two mutually parallel, coaxial braking shafts which are axially spaced apart and rotatable independently from each other. The two braking shafts are arranged at laterally opposing sides of the value document.

For aligning the value document, both braking shafts are rotated with a mutual time offset and/or rotated at different velocities in that angle range in which the value document is clamped between the cam roller and the rotatably supported roller. For example, the braking shaft rotation is started earlier for that braking shaft at which the value document arrives earlier than for the other braking shaft, so that the value document on the side of the braking shaft started earlier is brought in engagement with the cam of the cam roller at an earlier stage than with the other braking shaft. To determine the extent of the value document's oblique position and therefrom—with the help of the value-document velocity—the required time delay of the braking shafts, the braking device preferably has two laterally offset light barriers which register respectively the leading edge and/or trailing edge of the relevant lateral side of the value document.

The rotation of the braking shaft with the braking velocity will be maintained until the trailing edge of the value document leaves the clamping between the cam and the rotatably supported roller, is then accelerated to an angular velocity at which the circumferential velocity of the cam is higher than the circumferential velocity of the driving rollers, is thereafter again stopped and paused until the next value document is to be braked.

Moreover, the invention relates to a value-document processing apparatus which has the stacking apparatus according to the invention. The braking device is connectable to the transport system of the value-document processing apparatus to individually take over, i.e. to further transport, brake and stack, value documents being transported by the transport system. The value-document processing apparatus is, e.g., a value-document sorting machine which is configured for checking the value documents and for this purpose has corresponding sensors along the transport path of the value documents and, where applicable, also for the transporting of the value documents to different deposit means or stacking apparatuses.

BRIEF DESCRIPTION OF THE DRAWINGS

Further advantages of the present invention are to be found in the following description of embodiments examples. There are shown.

DETAILED DESCRIPTION OF VARIOUS EMBODIMENTS

Figure 1A:
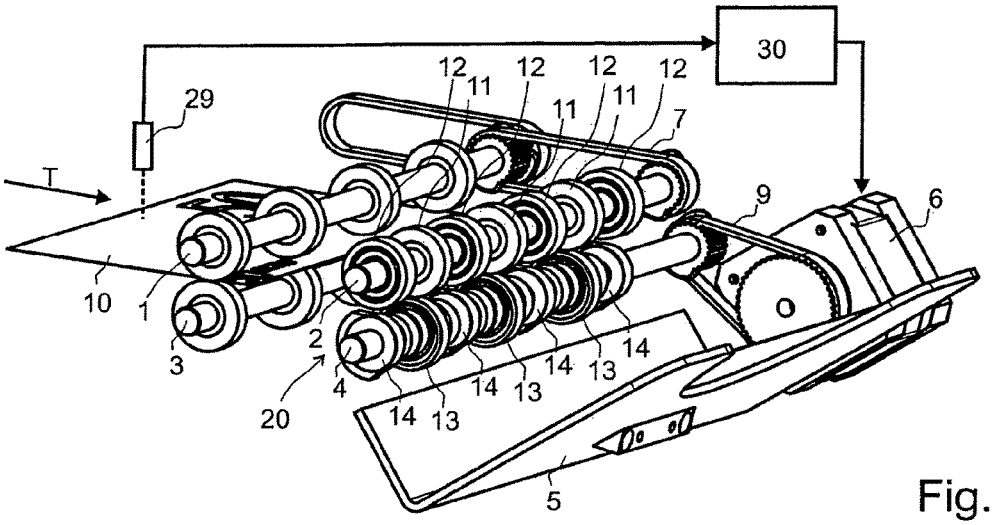
FIG. 1*a-c* An example of the arrangement of a braking device before a stack deposit means and the depositing of a value document on the stack deposit means at three characteristic time points of the braking shaft rotation, FIG. 2*a-c* the angular position of the cam roller and the eccentric roller at the three characteristic time points of FIG. 1*a-c*, FIG. 3 an example of a velocity profile of the braking shaft rotation, FIG. 4*a-b* a further embodiment example which also enables the alignment of the value document.
Figure 1B:
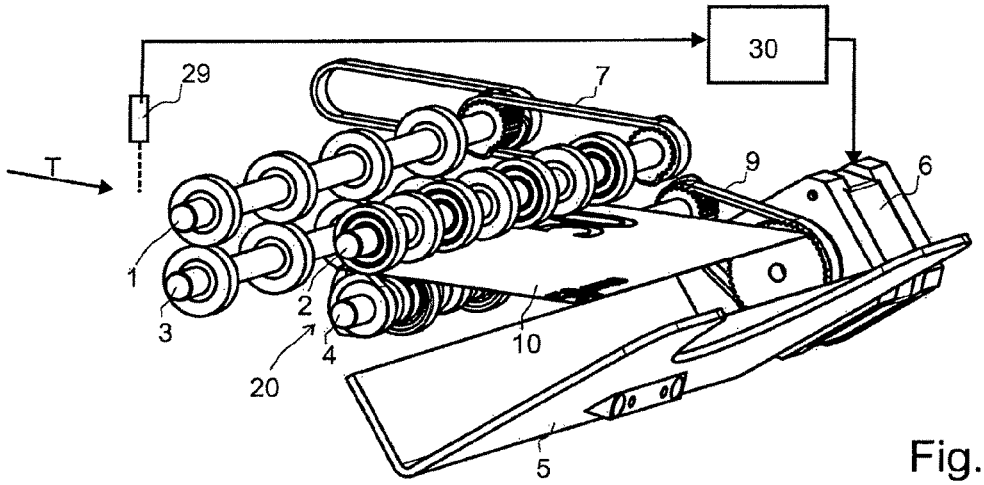
Figure 1C:
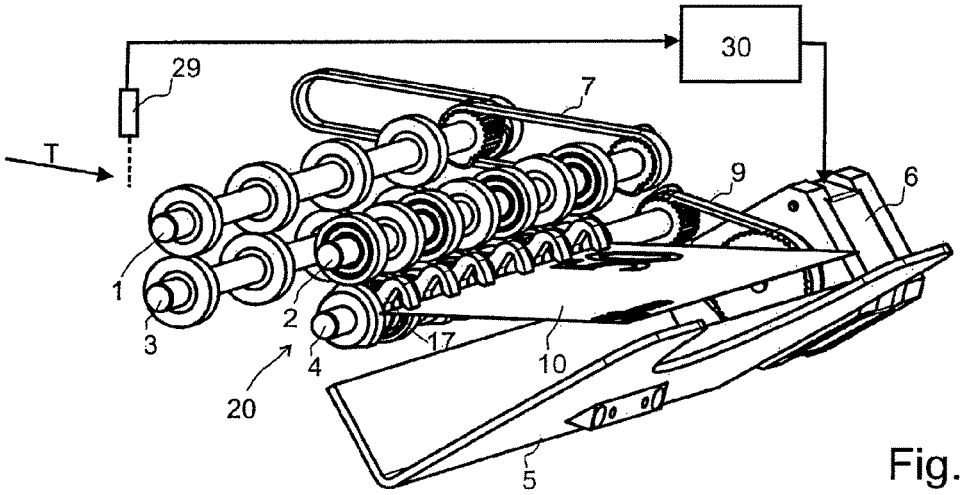

FIG. 1*a-c* show an embodiment example of the stacking apparatus with a braking device 20 which is arranged before a stack deposit means 5. In FIG. 1*a-c* three time points are represented shortly before the depositing of a value document 10 on the stack deposit means 5. In FIG. 1*a* the value document is being transported by a transport shaft pair 1, 3 of a transport system to the braking device 20 which is arranged before the stacking apparatus. The braking device 20 of the stacking apparatus is formed by the braking shaft 4 and the transport shaft 2 with their respective rollers 11, 12, 13, 14. The transport shaft 2 has several transport rollers 11 and several rotatably supported rollers 12. Several cam rollers 14 are mounted on the braking shaft which are opposite the rotatably supported rollers 12 of the transport shaft 2, and several eccentric rollers 13 which are opposite the driving rollers 11 of the transport shaft 2. For example, the cams 24 extend along the circumference of the cam rollers 14, over a length of at least 10 mm, preferably at least 15 mm. The eccentric rollers 13 have respectively an eccentric core 23 firmly mounted in eccentric position on the braking shaft 4 and an eccentric roller 33 rotatably supported on the eccentric core 23, cf. FIG. 2*a*.

The transport shaft 2 is rotated—in contrast to the braking shaft 4—at constant velocity. For example, it is rotated so fast that the circumferential velocity of the driving rollers corresponds to the transport velocity at which the value documents 10 are being transported by the transport roller pair 1, 3 to the braking device 20. This can be attained with the help of a mechanical coupling of the transport shaft 2 with the driven shaft 1 of the upstream transport shaft pair 1, 3, e.g. by means of a belt 7.

In this example, the driving rollers 11 and the rotatably supported rollers 12 are mounted alternately on the transport shaft, correspondingly also alternately the eccentric rollers 13 and the cam rollers 14 on the braking shaft. All eccentric rollers 13 are mounted at the identical angular position on the braking shaft 4. And all cam rollers 14 are also mounted in the same angular position on the braking shaft 4, however, in other angular position than the eccentric rollers 13.

In the shown example, the transport shaft 2 is above and the braking shaft 4 below the transport path of the value documents 10. Conversely, however, it is also possible to arrange the transport shaft 2 below and the braking shaft 4 above the transport path of the value documents 10. However, in any case the auxiliary elements 17, if present, are on that of the two shafts which is arranged under the transport path of the value documents.

Figures 2A, 2B, 2C:
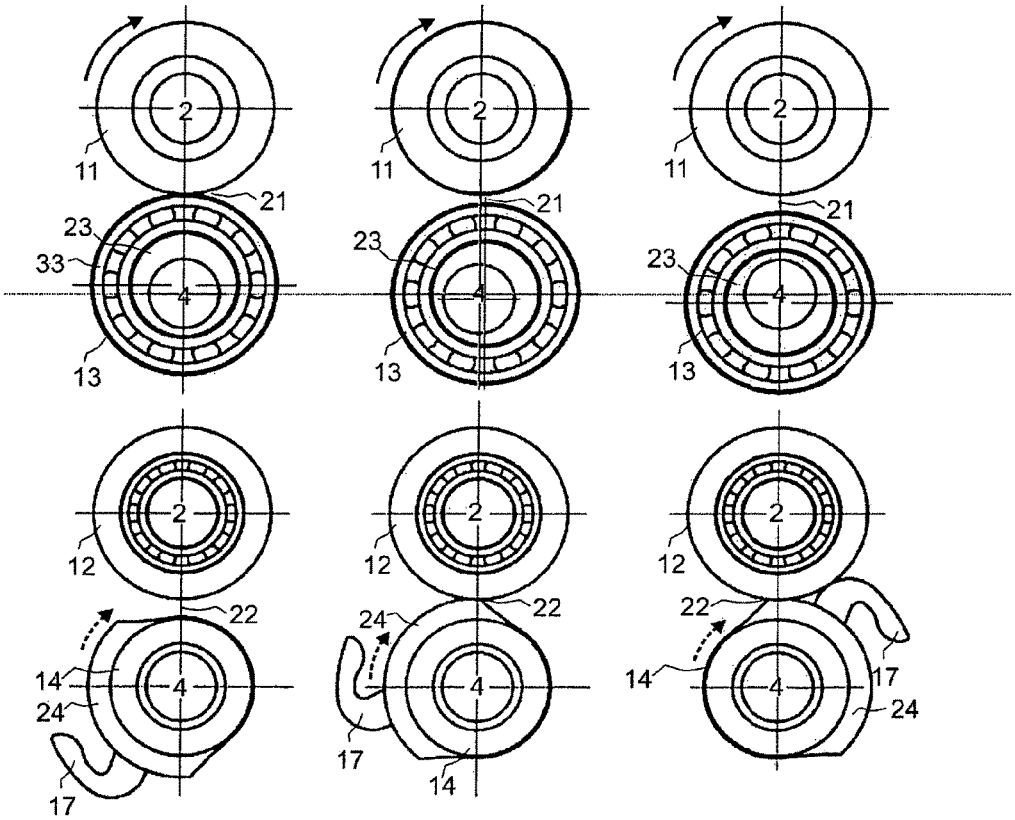

At the time of FIG. 1*a*, the driving rollers 11 are in engagement with the eccentric roller 13, for this purpose cf. also FIG. 2*a* above. There, the eccentric rollers 13 are at their upper extremum position. As soon as the value document 10 arrives in the braking device 20, it is captured by the clamping between the driving rollers 11 and the eccentric rollers 13 and is transported further by these at high velocity. At first the rotation of the braking shaft 4 is not yet effected. The braking shaft 4 in FIG. 1*a* stands at an angle for which the cams 24 of the cam roller 14 is not in engagement with the rotatably supported rollers 12, but rather there is a distance 22 between these in which the value document 10 is not clamped by these, but is transportable relative to these, cf. FIG. 2*a* below.

FIG. 1*b* and FIG. 2*b* show a time point at the beginning of the braking of the value document 10. Between the time points shown in FIGS. 1*a*, 2*a* and 1*b*, 2*b*, a rotation of the braking shaft 4 was performed, clockwise around a rotation angle of about 45°. The rotation of the braking shaft 4 is attained by a motor 6 which is mechanically coupled to the braking shaft 2 by a belt 9. Through this rotation of the braking shaft 2 a distance (distance 21) was attained between the eccentric rollers 13 and the driving rollers 11 at which the driving rollers 11 and the eccentric rollers 13 release the value document from their clamping, cf. FIG. 2*b* above. The value document 10 can then be braked relative to the driving rollers 11 and the eccentric rollers 13. The braking is effected with the help of the clamping between the cam rollers 14 of the braking shaft 4 and the rotatably supported rollers 12 of the transport shaft 2, which was likewise attained by the above-mentioned rotation of the braking shaft 4, cf. FIG. 2*b* below. The braking clamping of the value document 10 between cam rollers 14 and rotatably supported rollers 12 can be effected simultaneously with or shortly after the release of the clamping of the value document 10 between the driving rollers 11 and the eccentric rollers 13, but not before.

The rotating of the braking shaft 4 is so controlled that—at the beginning of the clamping between cam rollers 14 and rotatably supported rollers 12—the value document 10 has passed the braking device 20 already by at least half. The right starting time for the braking shaft rotation can be determined with the help of one or several light barriers 29 which are arranged along the transport path of the value documents 10 before the braking device (and, where applicable, also before the pair of transport rollers 1, 3). For this purpose the stacking apparatus has a control device 30, e.g. a microprocessor which is devised for this purpose, e.g. is accordingly programmed to carry out the stacking of the value documents as described. The control device 30 receives the trailing edge signal of the light barrier 29 and starts the motor 6 of the braking shaft 4 accordingly on time.

Up to the time points shown in the FIG. 1*c*, 2*c*, the braking shaft 4 was further rotated clockwise, namely relative to the time points of the FIG. 1*a*, 2*a* by approx. 180°. There, the eccentric rollers 13 are at their lower extremum position, i.e. the distance 21 between the eccentric rollers 13 and the driving rollers 11 is maximal. At the time point of FIG. 1*c*, 2*c*, the value document 10 has already left the clamping between the cam rollers 14 and the rotatably supported rollers 12 and is urged downward in the direction of stack deposit means 5 with the help of several hooks 17, which are likewise mounted on the braking shaft 4. The hooks 17 are arranged on the braking shaft 4 so angularly offset relative to the cams 24 of the cam rollers 14 that they act on the end of the value document 10 only after the value-document's trailing edge has left the clamping between cam rollers 14 and rotatably supported rollers 12.

Figure 3:
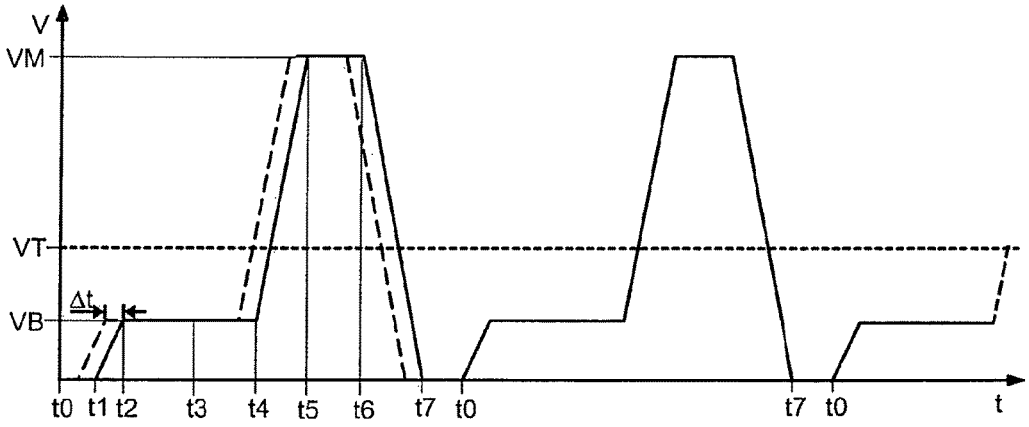

FIG. 3 shows by way of example a velocity profile (continuous line) for the rotation of the braking shaft 4 which is run through periodically. This velocity profile is stored in the control device 30, which actuates the motor 6 accordingly. In contrast to this, the transport shaft 2 is rotating permanently at a constant angular velocity VT. The time point shown in FIG. 1*a*, 2*a* lies between the time points t0 and t1, in which the angular velocity of the braking shaft 4 is still zero. At the time t1 the rotation of the braking shaft 4 begins. The braking shaft 4 is accelerated until it reaches the braking velocity VB at the time point t2. In the time window lying between t0 and t2, the eccentric rollers 13 urge the respective value document 10 against the respectively opposing driving roller 11 in order to further transport the value document 10 with the help of the friction between driving roller 11 and value document 10. The time point shown in FIG. 1*b*, 2*b* lies, e.g. exactly at t2 (or between the time points t2 and t3). At the time point t2, the braking shaft 4 has been rotated so far that the clamping is released between the driving rollers 11 and the eccentric rollers 13, and the cams 24 of the cam roller 14 with opposing rotatably supported rollers 12 take up the clamping of the value document 10, so that braking of the value document begins.

In the time window lying between t2 and t3, the value document is braked with the help of the friction between the cams 24 of the cam rollers 14 and the rotatably supported rollers 12. Between the eccentric rollers 13 and their opposing driving roller 11 there remains in this time window such a large distance 21 that the respective value document is not urged against the driving roller, but rather is brakable relative to the driving roller. At the time point t3, the trailing edge of the value document 10 leaves the clamping between the cams 24 of the cam rollers 14 and the rotatably supported rollers 12. Depending on the extension of the value document in transport direction, the time point t3 can also be moved somewhat on the time axis in the direction of t2 or t4.

At the time point t4, the end of the cam 24 leaves the engagement with respectively opposing rotatably supported roller 12. The braking shaft 4 is accelerated to a higher angular velocity VM>VB up to the time point t5. This angular velocity VM of the braking shaft 4 is also higher in this example than the (constant) angular velocity VT of the transport shaft 2. Thus it is attained that the eccentric rollers 13 are available on time in order to take over the next value documents 10 transported there by the pair of transport rollers 1, 3, i.e. to clamp it between the eccentric roller 13 and the driving rollers 11 so that said value document is further transported with the high transport velocity VT (to thereafter be braked like the preceding value document). The high rotating velocity VM is maintained up to the time point t6 and thereafter the rotation of the braking shaft 4 is braked. At the time point t7, the rotation of the braking shaft 4 is stopped again and the braking shaft 4 stands still up to the time point t0 of the next period.

Figure 4A:
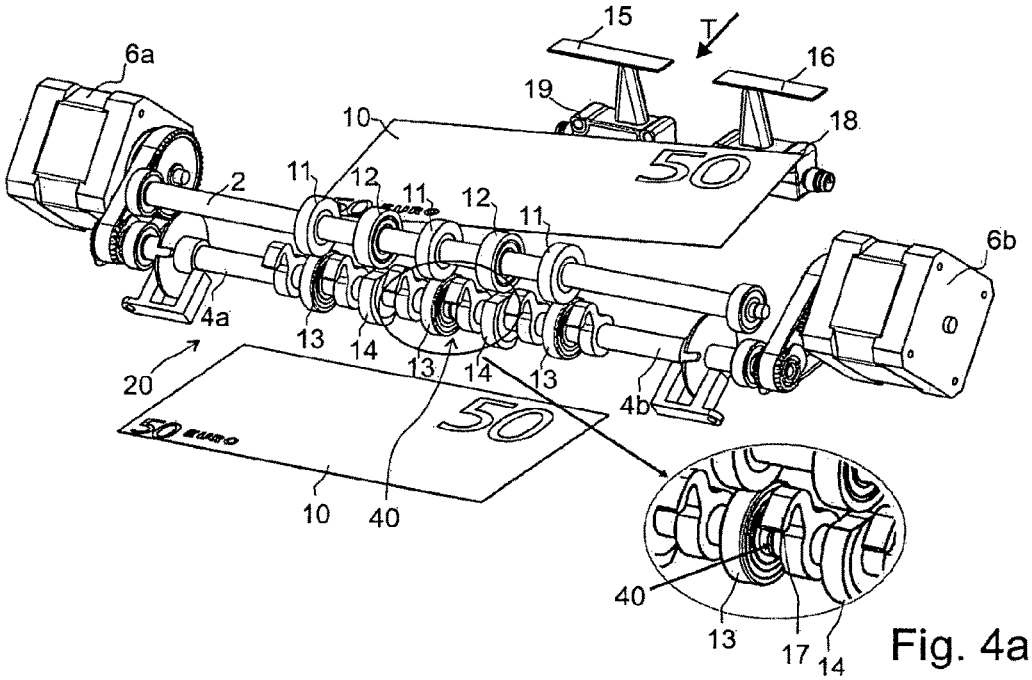
Figure 4B:
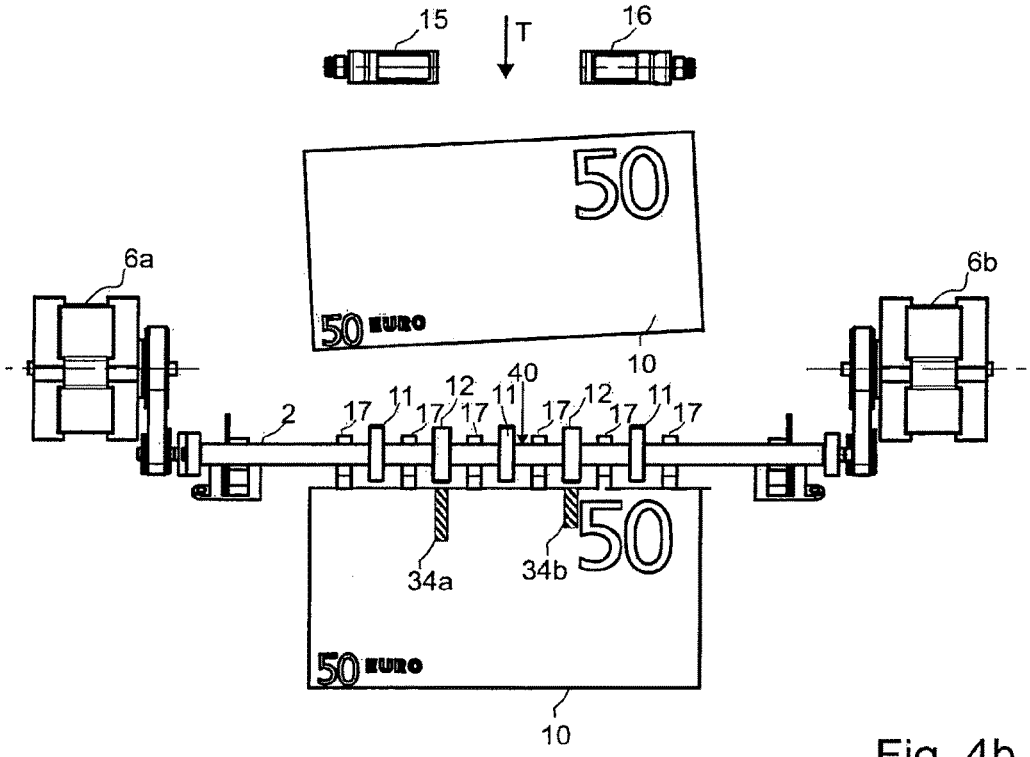

In FIG. 4*a*, a further embodiment example of a braking device 20 is shown, wherein the braking device has two braking shafts 4*a*, 4*b* coaxial to each other, which are axially spaced apart and are rotatable independently from each other. At a separation point 40 an axial distance exist between the two braking shafts 4*a*, 4*b*. The transport shaft 2 is further configured in one part. On each of the two braking shafts 4*a*, 4*b* a cam roller 14 is mounted, and, axially offset to the cam roller, an eccentric roller 13 (with braking shaft 4*b*) or two eccentric rollers 13 (with braking shaft 4*a*) which are respectively opposed correspondingly by a driving roller 11 or a rotatably supported roller 12, which are mounted on the transport shaft 2. The two braking shafts 4*a, b* are arranged along the two lateral sides of the value document (in FIG. 4*a, b* on the left and on the right). The section point 40 between the two braking shafts 4*a, b* lies e.g. approximately in the middle of the value document 10. In plan view shown in FIG. 4*b*, the braking shafts 4*a*, 4*b* are hidden by the transport shaft 2 arranged thereabove, just like the cam rollers 14 by the rotatably supported rollers 12 arranged thereabove, and the eccentric rollers 13 by the driving rollers 11 arranged thereabove.

Each of the two braking shafts 4*a*, 4*b* has its own motor 6*a* or 6*b*. The independent rotation of both braking shafts 4*a*, 4*b* enables—in addition to stacking—the aligning of the transported value documents 10, e.g. a straight alignment, if these are transported obliquely. Thus by a time-delayed braking of the two lateral sides of a value document 10, its oblique alignment can be corrected.

To determine the time delay by which the rotation of both braking shafts 4*a*, 4*b* should begin offset, the arrival time of the leading edge and/or trailing edge of the respective value document is measured, e.g. with the help of two light barriers. The reflective light barrier 19 having the appurtenant reflector 15 is associated with the braking shaft 4*a*, the reflective light barrier 18 having the appurtenant reflector 16 with the braking shaft 4*b*, cf. FIG. 4*a*. The signal of the reflective light barrier 19 is employed for the purpose of triggering the motor 6*a* of the braking shaft 4*a*; the signal of the reflective light barrier 18 is employed for the purpose of triggering the motor 6*b* of the braking shaft 4*b*. The different rotation of the two braking shafts 4*a*, 4*b* is controlled by the control device 30. In FIG. 3 the velocity profile for the left braking shaft 4*a* is sketched in dashes, which is employable for an aligning of the value document 10 from FIG. 4*a*.

Due to the fact that for the value document 10 shown in FIG. 4*a* the leading edge and the trailing edge of the value document 10 run ahead on the left side compared to the right side, the light barrier 19 registers the respective value-document edge earlier than the light barrier 18. Accordingly, the rotation of the left braking shaft 4*a* is also started earlier to brake the left side of the value document 10 earlier (and longer) than the right side. Hence the starting time of the braking for the left braking shaft 4*a* is earlier by a time delay Δt than for the right braking shaft 4*b*, cf. FIG. 3. The ending time of the braking is determined by the time point when the value document leaves the engagement of the cam 24. After the successful straight aligning, the trailing edge of the value document 10 leaves the engagement of the respective cam on the right and left side simultaneously, at the time t3. For example, the left side of the value document 10 is braked over a length of 14 mm and the right side over a length of 10 mm. The hatched portions 34*a* and 34*b* in FIG. 4*b* (which are, of course, not visible on the value document) indicate the brake regions of different length in which the respective cam 24 has braked the value document.

The invention claimed is:

1. A stacking apparatus for stacking value documents which are individually transported to the stacking apparatus by a transport system along a transport path at a transport velocity, the stacking apparatus comprising:

a stack deposit device for receiving a stack of the value documents, and a braking device for braking the value documents which were individually transported to the stacking apparatus by the transport system, wherein the braking device is arranged immediately before the stack deposit device along the transport path of the value documents, wherein the braking device has a transport shaft and a braking shaft oriented parallel thereto, between which the respective value document is transported through, on the transport shaft there is mounted at least one driving roller, which is firmly mounted on the transport shaft, and there is mounted at least one roller rotatably supported on the transport shaft, and on the braking shaft there is mounted at least one cam roller, which is firmly mounted on the braking shaft, and there is mounted at least one eccentric roller, wherein the at least one eccentric roller has an eccentric core firmly mounted on the braking shaft in an eccentric position, and wherein a cam of the cam roller and the eccentric core of the eccentric roller are mounted on the braking shaft at a mutual angular offset such that by a rotation of the braking shaft it can be attained that the cam of the cam roller can be brought into engagement with the opposing rotatably supported roller so that a value document transported through therebetween is clamped between the cam of the cam roller and the rotatably supported roller.

2. The stacking apparatus according to claim 1, wherein the roller rotatably supported on the transport shaft and the cam roller mounted on the braking shaft respectively lie opposite each other with regard to the transport path of the value documents.

3. The stacking apparatus according to claim 1, wherein the driving roller mounted on the transport shaft and the eccentric roller mounted on the braking shaft respectively lie opposite each other with regard to the transport path of the value documents.

4. The stacking apparatus according to claim 1, wherein the at least one eccentric roller has an eccentric core firmly mounted on the braking shaft in an eccentric position, and wherein a cam of the cam roller and the eccentric core of the eccentric roller are mounted on the braking shaft at a mutual angular offset such that in that angle range of the braking shaft rotation in which the eccentric roller is urged onto the opposing driving roller, the cam of the cam roller is not in engagement with the opposing rotatably supported roller, but rather there remains a space between the cam of the cam roller and the opposing rotatably supported roller, and in that angle range of the braking shaft rotation in which the cam of the cam roller is in engagement with the opposing rotatably supported roller, the eccentric roller is not in engagement with the opposing driving roller, but rather there remains a space between the driving roller and the eccentric roller in which space the respective value document is not urged against the driving roller by the eccentric roller, but rather is brakable relative to said rollers.

5. The stacking apparatus according to claim 1, wherein on a lower shaft of the braking device, which is arranged below the transport path of the value documents, there is firmly mounted on the lower shaft at least one auxiliary element which is configured such that the rearward end of the value document is urged in the direction of the stack deposit device upon rotation of the lower shaft.

6. The stacking apparatus according to claim 5, wherein the auxiliary element protrudes beyond a cam radially in the angle range of the cam of the cam roller.

7. The stacking apparatus according to claim 1, wherein the braking device has two mutually coaxial braking shafts which are axially spaced apart and are rotatable independently of each other, wherein on each of the two braking shafts there is firmly mounted at least one cam roller, and there is firmly mounted axially offset from the cam roller at least one eccentric roller, which has respectively an eccentric core firmly mounted on the respective braking shaft in eccentric position and an eccentric roller rotatably supported on the eccentric core.

8. The stacking apparatus according to claim 7, wherein the stacking apparatus has a control device which is adapted for rotating the two coaxial braking shafts with a mutual time offset and/or rotating them at different angular velocities in the angle range in which the value document is clamped.

9. The stacking apparatus according to claim 7, wherein the control device is configured such that for one of the two coaxial braking shafts at which the value document arrives earlier, the rotation is started earlier, so that the value document is brought in engagement with the cam of the respective cam roller and the respective rotatably supported roller sooner on the side of said braking shaft than on the side of the other braking shaft.

10. The stacking apparatus according to claim 1, wherein the at least one eccentric roller has an eccentric core firmly mounted on the braking shaft in an eccentric position, and wherein a cam of the cam roller and the eccentric core of the eccentric roller are mounted on the braking shaft at a mutual angular offset such that by a rotation of the braking shaft it can be attained that the eccentric roller can be brought into engagement with the opposing driving roller such that the value document is clamped between the eccentric roller and the driving roller.

11. The stacking apparatus according to claim 1, wherein the braking shaft is arranged below the transport path of the value documents, and on the braking shaft there is firmly mounted at least one auxiliary element which is configured such that the rearward end of the value document is urged in the direction of the stack deposit device upon rotation of the lower shaft.

12. The stacking apparatus according to claim 1, wherein the transport shaft is arranged below the transport path of the value documents, and on the transport shaft there is firmly mounted at least one auxiliary element which is configured such that the rearward end of the value document is urged in the direction of the stack deposit device upon rotation of the lower shaft.

13. The stacking apparatus according to claim 1, wherein the braking device has two mutually coaxial braking shafts which are axially spaced apart and are rotatable independently of each other, wherein on each of the two braking shafts there is firmly mounted at least one cam roller.

14. The stacking apparatus according to claim 13, wherein there is firmly mounted axially offset from the cam roller at least one eccentric roller, which has respectively an eccentric core firmly mounted on the respective braking shaft in an eccentric position and an eccentric roller rotatably supported on the eccentric core.

15. The stacking apparatus according to claim 1, wherein the at least one eccentric roller has an eccentric core firmly mounted on the braking shaft in an eccentric position, and an eccentric roller rotatably supported on the eccentric core.

16. A method for stacking value documents using a stacking apparatus, the value documents being individually transported to the stacking apparatus by a transport system along a transport path at a transport velocity, the method comprising:

braking the value documents that are individually transported to the stacking apparatus by the transport system with a braking device, wherein the braking device is arranged immediately before a stack deposit device along the transport path of the value documents, and receiving the stack of the value documents with the stack deposit device, wherein the braking device has a transport shaft and a braking shaft oriented parallel thereto, between which the respective value document is transported through, on the transport shaft there is mounted at least one driving roller, which is firmly mounted on the transport shaft, and there is mounted at least one roller rotatably supported on the transport shaft, and on the braking shaft there is mounted at least one cam roller, which is firmly mounted on the braking shaft, and there is mounted at least one eccentric roller.

17. The method according to claim 16, wherein rotation of the transport shaft is effected at a constant angular velocity with a circumferential velocity of the driving roller corresponding to the transport velocity at which the value documents are transported to the braking device by the transport system.

18. The method according to claim 16, wherein the braking shaft has a velocity profile such that the braking shaft does not rotate as long as the leading edge and a leading portion of the value document are being transported past the braking device, and at a time point while a trailing portion of the value document is being transported past the braking device, rotation of the braking shaft is started and the angular velocity of the cam roller is accelerated to a braking velocity with a circumferential velocity of the cam of the cam roller is being substantially lower than the transport velocity at which the value documents were transported through the driving roller.

19. The method according to claim 16, wherein rotation of the braking shaft is so coordinated with the arrival time of the respective value document, in particular of the trailing edge of the respective value document, that the engagement between the respective cam of the cam roller and the respective rotatably supported roller begins at a place on the value document which lies in the trailing half of the value document, wherein the cam is so long along the circumference that said engagement persists at least until the trailing edge of the value document leaves the clamping between the cam and the rotatably supported roller.

20. The method according to claim 16, wherein rotation of the braking shaft is not effected uniformly, but according to a periodic velocity profile which is run through exactly once for each value document to be braked.

21. A value document processing apparatus comprising:

a stacking apparatus; and a transport system with which the value documents are individually transported to the stacking apparatus;

wherein the stacking apparatus includes a stack deposit device for receiving a stack of the value documents, and a braking device for braking the value documents which were individually transported to the stacking apparatus by the transport system, wherein the braking device is arranged immediately before the stack deposit device along the transport path of the value documents, wherein the braking device has a transport shaft and a braking shaft oriented parallel thereto, between which the respective value document is transported through, on the transport shaft there is mounted at least one driving roller, which is firmly mounted on the transport shaft, and there is mounted at least one roller rotatably supported on the transport shaft, and on the braking shaft there is mounted at least one cam roller, which is firmly mounted on the braking shaft, and there is mounted at least one eccentric roller.

22. The value document processing apparatus according to claim 21, wherein the value document processing apparatus further comprises a control device which is configured to control the stacking apparatus such that rotation of the braking shaft is not effected uniformly, but according to a periodic velocity profile which is run through exactly once for each value document to be braked.

* * * * *